United States Patent [19]

Wood

[11] Patent Number: 4,794,712

[45] Date of Patent: Jan. 3, 1989

[54] PORTABLE DISPLAY DEVICE

[75] Inventor: Donald L. Wood, Riverview, Fla.

[73] Assignee: Showboard, Inc., Tampa, Fla.

[21] Appl. No.: 118,980

[22] Filed: Nov. 10, 1987

Related U.S. Application Data

[63] Continuation of Ser. No. 800,663, Nov. 12, 1985, abandoned.

[51] Int. Cl.[4] ..... G09F 7/00

[52] U.S. Cl. ..... 40/605; 40/124.1; 211/195; 248/472

[58] Field of Search ..... 40/124.1, 605, 152.1; 248/472; 211/194, 195

[56] References Cited

U.S. PATENT DOCUMENTS

| | | | |
|---|---|---|---|
| 1,368,483 | 2/1921 | Carter | 40/124.1 |
| 1,522,118 | 1/1925 | Lodge | 40/124.1 |
| 1,708,019 | 4/1929 | Krotoschin | 40/124.1 |
| 1,802,553 | 4/1931 | Dyment | 40/124.1 |
| 1,915,762 | 6/1933 | Rost | 40/124.1 |
| 2,142,547 | 1/1939 | Anderson | 40/539 |
| 2,142,548 | 1/1939 | Anderson | 40/539 |
| 2,142,549 | 1/1939 | Anderson | 40/124.1 |
| 3,029,051 | 4/1962 | Nichols | 248/472 |
| 3,473,777 | 10/1969 | Ketterer | 248/472 |
| 4,030,219 | 6/1977 | Donovan | 211/195 |
| 4,623,066 | 11/1986 | Talbot | 211/195 |
| 4,657,149 | 4/1987 | Masson | 211/195 |
| 4,676,383 | 6/1987 | Sheffer | 211/195 |

*Primary Examiner*—Gene Mancene
*Assistant Examiner*—Wenceslao J. Contreras
*Attorney, Agent, or Firm*—A. W. Fisher, III

[57] ABSTRACT

A portable display device for displaying educational material or student's work comprising a plurality of panels, each panel separated from the next adjacent panel by a score line to permit relative movement between adjacent panels, each panel comprising a base portion including a first and second corrugated substantially rigid section separated by a substantially rigid member and a writing surface adhered to the outer surface of the first corrugated substantially rigid section, the score line formed between adjacent panels extending entirely through the second corrugated substantially rigid section and a portion of the first corrugated substantially rigid section such that adjacent panels may be folded relative to each other for storage and transport or extended relative to each other for display.

2 Claims, 1 Drawing Sheet

FIG. 1
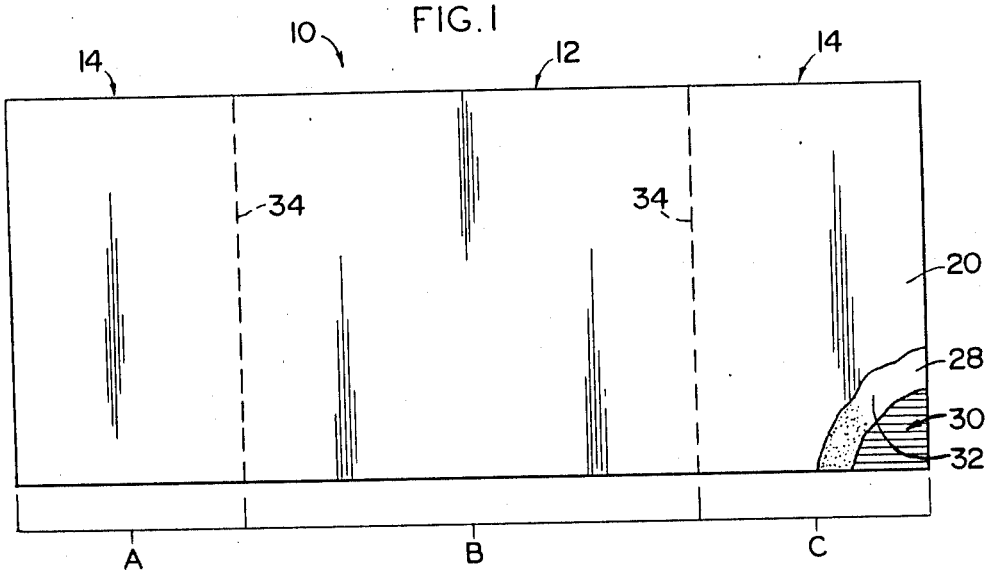
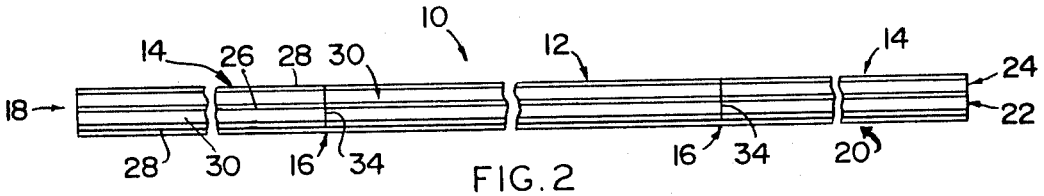
FIG. 2
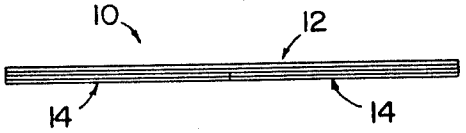
FIG. 3
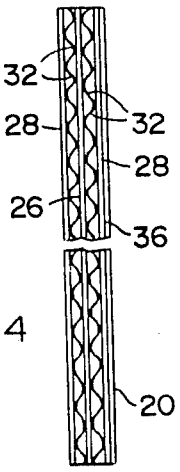
FIG. 4
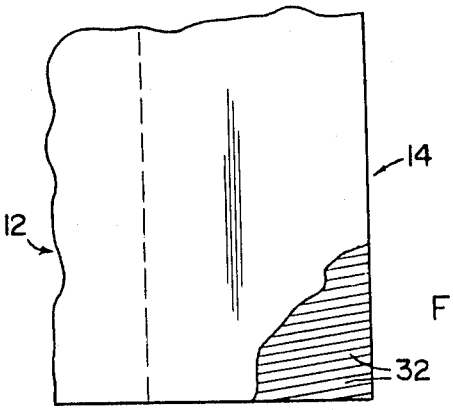
FIG. 5

PORTABLE DISPLAY DEVICE

This application is a continuation of Ser. No. 800,663 filed 11/12/85 and which is now abandoned.

BACKGROUND OF THE INVENTION

1. Field of the Invention

A portable display device for displaying educational material or student's work.

2. Description of the Prior Art

Primary and secondary schools require or conduct various science fairs and the like. Typically, studens use flexible poster board to prepare the displays associated with these science fairs. It is often necessary to affix such flexible poster board to a wood or other rigid backing to provide strength and durability to the entire display. Not only is the assembly and construction of these displays difficult but the transportation of such display is generally awkward and cumbersome.

Examples of foldable or collapsible easles or stands are disclosed in U.S. Pat. No. 2,507,620; U.S. Pat. No. 3,119,194; U.S. Pat. No. 3,275,280; U.S. Pat. No. 3,508,734 and U.S. Pat. No. 3,990,669.

Numerous foldable or collapsible blackboards have also been developed. Such devices are shown in U.S. Pat. No. 210,044; U.S. Pat. No. 2,109,723; U.S. Pat. No. 2,881,538; U.S. Pat. No. 3,034,230 and U.S. Pat. No. 3,659,355.

In addition various foldable picture frames, greeting cards or letters and writing pads have been created. Examples of these efforts are found in U.S. Pat. No. 1,354,176; U.S. Pat. No. 1,757,287; U.S. Pat. No. 2,443,645; U.S. Pat. No. 2,453,902; U.S. Pat. No. 2,504,277 and U.S. Pat. No. 4,167,241.

Unfortunately these prior art examples do not combine a sturdy, durable structure with ease of transport and storage necessary for use as in the instant invention.

SUMMARY OF THE INVENTION

The present invention relates to a portable display device for displaying educational material or student's work comprising a center panel having a pair side panels hingedly attached to opposite ends thereof on a corresponding pair of hinges.

The horizontal dimension or width of the side panels relative to that of the center panel permits folding of the side panels in substantially coplanar relationship relative to each other and in substantially parallel relationship relative to the center panel for storage or transport.

The center panel and each of the side panels comprises a base portion and a writing or display surface. Each base portion comprises a first and second corrugated substantially rigid section each including an outer substantially rigid surface and an inner corrugated portion having horizontally disposed ridges.

Each hinge comprises a scoring or cut line extending through the second corrugated substantially rigid section and a portion of the first corrugated substantially rigid section. The horizontally disposed rigids are inclined relative to the scoring or cut lines and hinges to provide the necessary supporting strength between adjacent panels.

In use, the side panels are opened outwardly relative to the center panel on the hinges permitting the student to write on or affix legends on the writing or display surface. Once the project is completed, the side panels may be folded inwardly relative to the center panel along the hinges for storage or transport.

To effect the display, the portable display device is placed vertically on a supporting surface with the side panels opened outwardly relative to the center panel to permit viewing of the writing or display surface.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which:

FIG. 1 is a front view of the portable display device in the open or display position.

FIG. 2 is an enlarged partial cross-sectional top view of the portable display device.

FIG. 3 is a top view of the portable display device in the closed or storage/transport position.

FIG. 4 is a partial cross-sectional side view of the portable display device.

FIG. 5 is a schematic partial cross-sectional front view of an alternate embodiment of the portable display device.

Similar reference characters refer to similar parts throughout the several views of the drawings.

DETAILED DESCRIPTION OF THE PREFERRED EMBODIMENT

As best shown in FIGS. 1 and 2, the present invention relates to a portable display device generally indicated as 10 for displaying educational material or student's work.

The portable display device 10 comprises a center panel generally indicated as 12 having a pair of side panels each generally indicated as 14 hingedly attached to opposite ends thereof on hinges each indicated as 16. The horizontal dimension or width indicated as A of each side panel 14 is substantially one-half the horizontal dimension or width indicated as B of the center panel 12 to permit folding of the side panels 14 in substantially coplanar relationship relative to each other and in substantially parallel to the center panel 12 as shown in FIG. 3 for storage or transport.

As best shown in FIG. 2, the center panel 12 and each side panel 14 comprises base portion generally indicated as 18 and a writing or display surface generally indicated as 20. Each base portion 18 comprises a first and second corrugated substantially rigid section generally indicated as 22 and 24 respectively separated by a substantially rigid surface 26. The first and second corrugated substantially rigid section 22 and 24 each comprises an outer substantially rigid surface 28 and an inner corrugated portion 30 having horizontally disposed ridges or corrugation each indicated as 32 (FIG. 4) or inclined as shown in FIG. 5.

As best shown in FIG. 2, a hinge line 34 comprises a scoring or cut line indicated as 34 extending through the outer substantially rigid surface 28 of the second corrugated substantially rigid section 24, both inner corrugated portions 28 and the substantially rigid surface 26 such that the outer substantially rigid surface 28 of the first corrugated substantially rigid section 22 and the writing or display surface 20 form the hinges 16 along the corresponding scoring or cut lines 34.

As best shown in FIGS. 4 and 5, the horizontally disposed ridges or corrugation 32 are inclined relative to the scoring or cut lines 34 and the hinges 16 the provide the necessary support strength between adjacent panels 12 and 14.

As best shown in FIG. 4, substantially the entire surfaces between writing or display surface 20 and the outer substantially rigid surface 28 of the first corrugated substantially rigid section 22 are adhered together as at 36.

Alternately the outer substantially rigid surface 28 of the first corrugated substantially rigid section 22 may comprise bleached white kraft material thus suitable as the writing or display surface 20 thus precluding the necessity of an additional thickness.

It is envisioned that the portable display device 10 may comprise various overall sizes varying in height such as 2×4, 3×4 or 4×4 feet.

In use, the side panels 14 are opened outwardly relative to the center panel 12 on hinges 16 permitting the student to write on or affix legends on the writing or display surface 20. Once the project is completed, the side panels 14 may be folded inwardly relative to the center panel or along the hinges 16 as shown in FIG. 3 for storage or transport.

To effect the display, the portable display device 10 is placed vertically on a supporting surface with the side panels 14 opened outwardly relative to the center panel 12 to permit reviewing of the writing or display surface 20.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A portable display device for displaying educational or informational material comprising a plurality of panels including a center panel having a side panel hingedly attached to opposite ends thereof, each said panel separated from the next adjacent panel by a score line to permit relative movement between adjacent panels, each said panel comprises a first and second corrugated substantially parallel rigid section separated by a substantially rigid member, each said first and second corrugated substantially parallel rigid section comprises an outer rigid surface and an inner corrugated portion, each said score line extends through said outer rigid surface of said second corrugated rigid section and both said inner corrugated portions whereby said outer substantially rigid surface of said first corrugated rigid section forms a hinge between said adjacent panels along said score lines, said outer substantially rigid surface of said first corrugated rigid section forming a display surface, each said inner corrugated portions comprises a plurality of ridges, the longitudinal centerline of said plurality of ridges being inclined relative to the longitudinal centerline of each said score line, the width of each said side panel being less than one-half the width of said center panel to permit folding of said side panels in substantially coplanar relationship relative to each other and in substantially parallel relationship to said center panel such that said adjacent panels may be folded relative to each other for storage and transport and the width of said side panels is between one-eighth to one-third the height of said portable display device to provide stability when said panels are extended from said parallel, coplanar relationship selectively from 0 degrees to 90 degrees relative to said adjacent panel for display.

2. The portable display device of claim 1 wherein said display surface of said first corrugated rigid section comprises an at least partially bleached kraft surface.

* * * * *